US006632109B2

(12) United States Patent
Irwin et al.

(10) Patent No.: US 6,632,109 B2
(45) Date of Patent: Oct. 14, 2003

(54) POWDER COATED TERMINAL STUD ASSEMBLIES AND METHODS OF FABRICATING

(75) Inventors: Patricia Chapman Irwin, Altamont, NY (US); Peter John Foley, Scotia, NY (US); James Frederick Hopeck, Mechanicsville, NY (US); Ronald Irving Longwell, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 154 days.

(21) Appl. No.: 09/892,912

(22) Filed: Jun. 28, 2001

(65) Prior Publication Data

US 2003/0003813 A1 Jan. 2, 2003

(51) Int. Cl.[7] ..... H01R 13/05
(52) U.S. Cl. ..... 439/825; 439/936
(58) Field of Search ..... 439/825, 700, 439/824, 842–843, 851–857, 655, 936

(56) References Cited

U.S. PATENT DOCUMENTS 3,646,347 A * 2/1972 Jordan et al.
5,316,801 A * 5/1994 Hopeck ..... 427/486
5,358,432 A 10/1994 Shih et al.

* cited by examiner

*Primary Examiner*—Khiem Nguyen
(74) *Attorney, Agent, or Firm*—Nixon & Vanderhye

(57) ABSTRACT

The main and collector terminal studs of a dynamoelectric machine are coated with a powder resin to form an electrical insulator between the rotor and the stud. The collector terminal stud includes a gasket which is compressed against the powder coating on the stud to form a seal with the powder coating preventing leakage of hydrogen gas through the seal. A fluidized bed containing the resin powder disperses the powder in a mist. By charging the powder, an electrostatic potential is provided between the stud and charged powder whereby the powder adheres to the stud. Alternatively, the stud will be preheated and dipped into a bed of powder whereby the powder adheres to the stud. The powder resin is subsequently cured.

9 Claims, 2 Drawing Sheets

POWDER COATED TERMINAL STUD ASSEMBLIES AND METHODS OF FABRICATING

BACKGROUND OF THE INVENTION

The present invention relates to connections between a bore connector or copper and field windings and exciter rings at opposite ends of the bore connector in dynamoelectric machines and particularly relates to terminal studs having powder coated electrical insulation.

The rotors of dynamoelectric machines typically comprise relatively large-diameter cylindrical bodies containing field windings for producing magnetic flux which, in turn, produces stator current and voltage. These field windings are normally carried in a series of longitudinal slots along the outer circumference and extend the length of the rotor body, terminating in end turns. The rotor is also provided with a bore connector, also known as "bore copper" (insulated conductors embedded in small-diameter shafts that extend from opposite ends of the rotor body for electrical connection with the exciter/rectifier assembly). The bore connectors make electrical connection at opposite ends with the field winding and the exciter brushes.

To make electrical connection between the field windings and the inner end of a bore connector, a main terminal is inserted into a radial bore of the rotor shaft. The main terminal has tapered threads at its radial inner end for engaging female tapered threads in the bore connector. The opposite end of the main terminal is electrically coupled via flexible leaves to the field winding. At the opposite end of the bore connector, a collector terminal stud electrically interconnects the bore connector and the exciter brushes. Conventionally, the terminal studs are electrically insulated from the rotor by hand-wound epoxy glass cloth composite insulation. Manual application of the insulation is costly and inconsistent. Additionally, in hydrogen-cooled generators, it is necessary that the collector terminal stud serve also as a mechanical seal to contain the coolant hydrogen gas within the generator. The cloth insulation has a permeability to hydrogen and is thus not an ideal material with which to form a seal. Accordingly, there is a need for terminal studs in electrical generators which have improved dielectric properties, as well as sealing capacity.

BRIEF SUMMARY OF THE INVENTION

In accordance with a preferred embodiment of the present invention, the terminal studs of a generator are coated with a powdered electrical insulating material. The powder coated insulation has equal or better dielectric strength than the prior cloth electrical insulation and is less hydrogen-permeable in those applications where the terminal stud is required to serve both as an electrical insulator and a seal, i.e., at the collector terminal stud. The powdered insulation may comprise an epoxy material which is commercially offered by the 3M Company under the tradename Epoxy 3M 5230. It has been found that terminal studs coated with the powder insulation have improved properties, as outlined below.

The powder insulation may be applied by a number of different methods, including employing an electrostatic fluid bed using an electrostatic charge to contact the powder particles with the terminal stud, a spray gun to spray electrostatically charged particles onto the terminal stud or a fluidized bed where the part is preheated and dipped into the bed to bond the particles to the stud. With respect to the collector terminal stud, a gasket is compressed by a threaded nut to engage radially about the powder coated insulation on the collector stud to seal thereagainst. Because the powder insulation is smooth, the gasket is more fully compliant against the powder, forming a more effective seal upon comparison with the seal formed using cloth composite insulation as in the past.

In a preferred embodiment according to the present invention, there is provided in a dynamoelectric machine having a rotor, a radial bore in the rotor, a bore connector extending generally in an axial direction along a portion of the rotor and having a generally radially outwardly opening threaded aperture, a stud in the radial bore for electrically coupling the bore connector and electrical contacts carried by the rotor, the stud having a threaded connection at one end for threaded engagement with the bore connector in the threaded aperture thereof and an electrical insulator about a portion of the stud for electrically insulating the stud and the rotor from one another, the insulator including a thermoset or thermoplastic powder resin coating on the insulator portion.

In a further preferred embodiment according to the present invention, there is provided in a dynamoelectric machine having a rotor, a radial bore in the rotor, a bore connector extending generally in an axial direction along a portion of the rotor and having a generally radially outwardly opening threaded aperture, a stud in the radial bore for electrically coupling the bore connector and electrical contacts carried by the rotor, the stud having a threaded connection at one end for threaded engagement with the bore connector in the threaded aperture thereof, a method of forming the stud with an electrical insulator about a portion of the stud comprising the steps of (a) providing an electrostatic fluid bed containing a thermoset or thermoplastic resin powder, (b) passing air through the powder in the bed to obtain a rolling boil of the powder, (c) applying an electrostatic potential to the powder in the bed, (d) grounding the stud enabling the powder to be attracted to and forming a coating on the stud and (e) curing the powder after application to the stud.

In a further preferred embodiment according to the present invention, there is provided in a dynamoelectric machine having a rotor, a radial bore in the rotor, a bore connector extending generally in an axial direction along a portion of the rotor and having a generally radially outwardly opening threaded aperture, a stud in the radial bore for electrically coupling the bore connector and electrical contacts carried by the rotor, the stud having a threaded connection at one end for threaded engagement with the bore connector in the threaded aperture thereof, a method of applying powder resin to the stud comprising the steps of (a) spraying electrostatically charged thermoset or thermoplastic resin powder onto the stud and (b) grounding the stud to cause the sprayed powder resin to adhere to the surface of the stud and curing the resin on the stud.

In a further preferred embodiment according to the present invention, there is provided in a dynamoelectric machine having a rotor, a radial bore in the rotor, a bore connector extending generally in an axial direction along a portion of the rotor and having a generally radially outwardly opening threaded aperture, a stud in the radial bore for electrically coupling the bore connector and electrical contacts carried by the rotor, the stud having a threaded connection at one end for threaded engagement with the bore connector in the threaded aperture thereof, a method of applying a resin powder to a stud comprising the steps of (a) providing a fluidized bed containing thermoset or thermoplastic powder, (b) fluidizing the powder in the bed to a rolling boil, (c) preheating the stud, (d) disposing the stud into the powder within the bed to adhere the powder to the stud and (e) curing the powder on the stud.

DETAILED DESCRIPTION OF THE INVENTION

Figure 1:
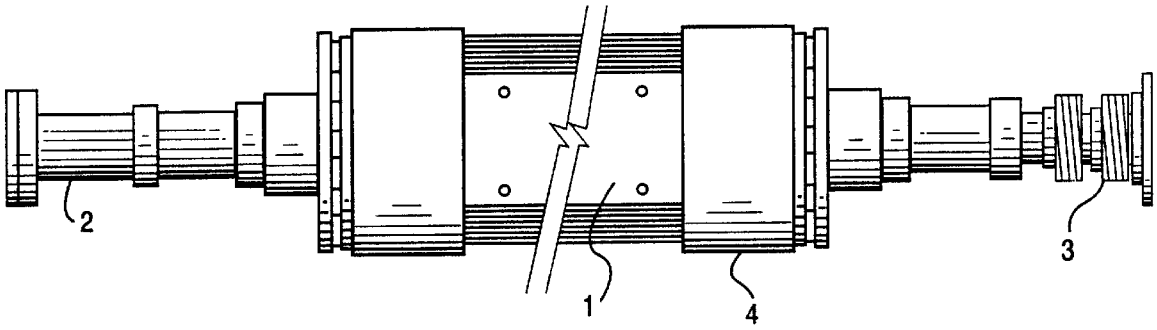
FIG. 1 (Prior Art)
FIG. 1 is a schematic illustration of a conventional rotor for a dynamoelectric machine.

Referring now to the drawings, particularly to FIG. 1, there is illustrated a rotor 1 for a dynamoelectric machine such as a generator. The rotor 1 includes end shafts 2 which contain insulated conductors, i.e., bore connectors or bore copper which extend longitudinally along the end shafts 2 between the exciter/slip rings 3 and the rotor field windings located on the rotor within the retaining rings 4. As will be appreciated and is conventional, the rotor includes a series of longitudinally extending radially open slots, not shown, having dovetail-shaped longitudinal grooves adjacent the periphery of the rotor. Field windings are inserted into the slots and extend the length of the rotor body and axially beyond the ends of the rotor to include end turns 7 (FIG. 2) for connecting the winding of one slot with the winding of another slot.

Figure 2:
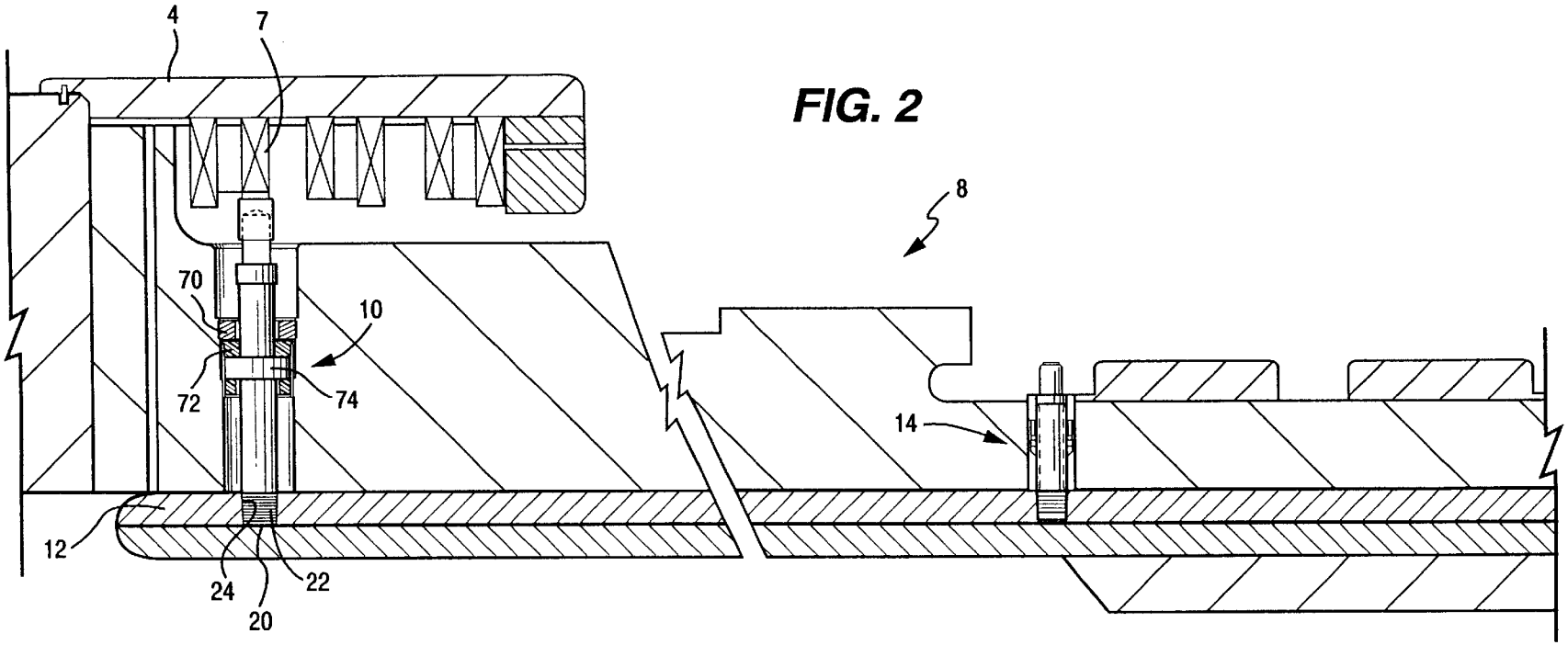
FIG. 2 is an enlarged longitudinal cross-sectional view through an end portion of a rotor illustrating a preferred embodiment of the present invention.

As illustrated in FIG. 2, a main terminal stud, generally designated 10, interconnects between the field windings 7 and a bore connector or copper 12 in a rotor, generally indicated 8. The bore copper is electrically insulated from the rotor, for example, by insulation, not shown. Similarly, the main terminal stud 10, while conducting electricity between the bore copper and windings is likewise electrically insulated from the rotor, as discussed below. The lower or inner end 20 of the main terminal stud 10 includes tapered male threads 22 for threading engagement with complementary female threads formed in an aperture 24 in the bore copper 12 whereby the terminal stud is fixed to the bore copper within the radial bore of the rotor.

Adjacent the opposite end of the bore connector 12, there is provided a collector terminal stud, generally designated 14. The collector terminal stud similarly has inner or lower tapered male threads threaded in the complementary female threaded aperture of the bore copper for transmitting electricity between the bore connector and the exciter/slip rings. The collector terminal stud 14 is illustrated in FIG. 3.

Figure 3:
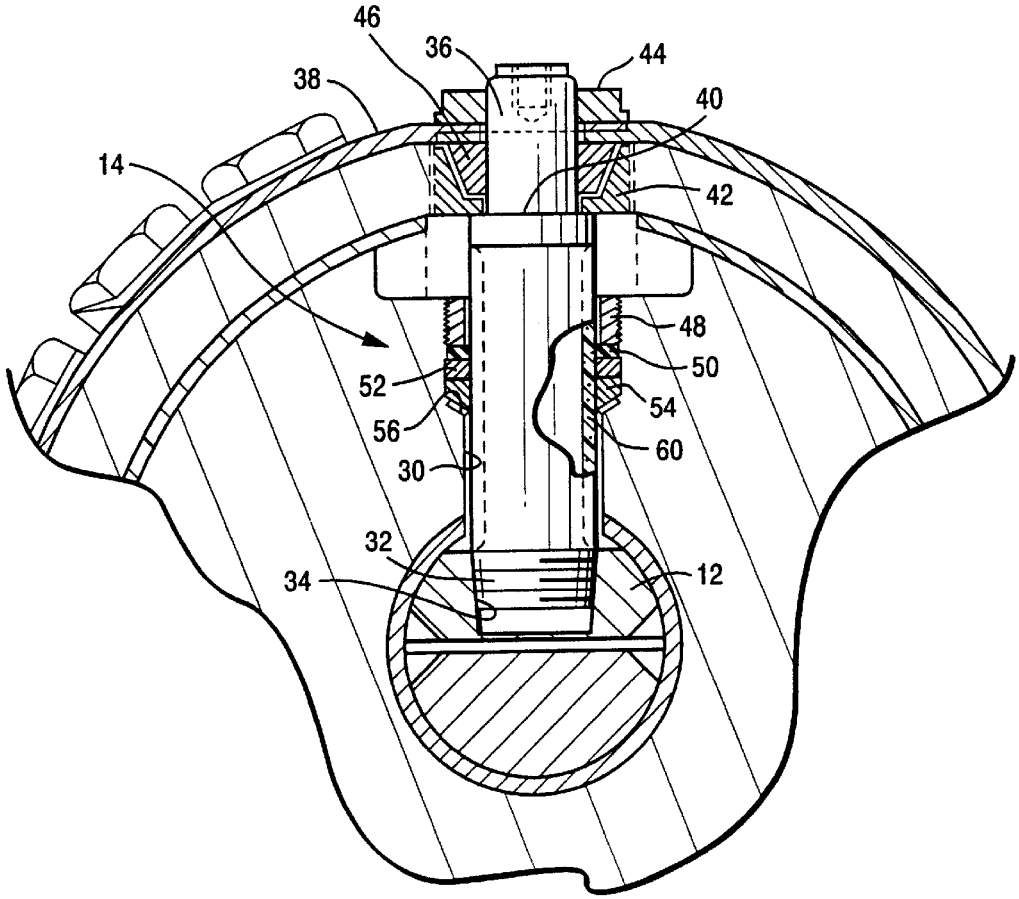
FIG. 3 is a cross-sectional view of the collector terminal stud sealed within the rotor when connected to the bore connector.

Specifically, and referring to FIG. 3, the collector terminal stud 14 is received in a radial opening or bore 30 in the rotor. The radially inboard end of the terminal stud includes male tapered threads 32 for threaded engagement with female complementary threads 34 formed in the bore copper 12. The radial outer end of the generally cylindrical collector terminal stud 14 includes a reduced diameter terminal 36 electrically coupled to straps 38 which, in turn, connect to connector rings which rotate relative to the stationary brushes, not shown. The shoulder 40 formed on the stud 14 is engaged by a male threaded nut 42 which threads into the radial outer end of the bore 30. A nut 44 is also threaded about the outer end of the stud 36 to retain the straps between the nut 44 and an insulating washer 46.

As illustrated, a male threaded nut 48 is threaded along complementary female threads formed intermediate the ends of the bore 30. Radially inwardly of nut 40 is a sealing gasket 50 formed of electrically insulating deformable material. Below gasket 50 is a non-compressible washer 52 and a further non-compressible washer 54 engaging a tapered shoulder 56 of the bore 30. By threading nut 48 during installation, the gasket 50 is compressed and expands radially inwardly to engage about the powder coated surface 60 on the collector terminal stud. The gasket thus seals against the radial bore wall as well as against the powdered coating 60 of the collector terminal stud 14. It will be appreciated that sealing at this location seals between a hydrogen environment radially inwardly of the gasket 50 and atmosphere on the radially outward side of gasket 50.

The powder coated insulation 60 thus not only forms an electrical insulating layer between the rotor and stud 14 but also serves to facilitate and provide a more robust seal about the stud. Thus, the powder coated insulation serves as a mechanical seal to contain coolant hydrogen gas within the generator and presents a less hydrogen-permeable electrically insulating substance than previous. The powder coated insulation may comprise an epoxy resin, an acrylic/silicone blended resin, an epoxy/silicone blended resin; thermoplastic resins which include but are not limited to polyetherimides, polysulfones, polyetheretherketone, polyetherketonelactone, polyesterimide, or a polyester resin, which is particularly useful for low temperature applications such as small generators or air-cooled machines. A particular and preferable powder is commercially available from the 3M Company and identified as Epoxy 3M 5230.

The powder coating may be applied to both of the main terminal and collector terminal studs 10 and 14, respectively, by any number of methods. In a preferred method, an electrostatic fluid bed is provided. The powder is disposed in the bed and air is passed through the bed to obtain a rolling boil of the powder. An applied high potential is provided in the air to afford free electrons which are passed to the powder. As the powder is charged and the stud is located within the cloud of powder in the fluidized bed, the electrostatic potential enables the powder to be attracted to the metallic stud. The powder coating thickness builds up as a function of the voltage and time. Because of the electrostatic charge, the powder may be cured onto the metallic stud over a period of time.

Instead of disposing the stud in a cloud of powder, a spray gun may be utilized. The tip of the spray gun through which the powder exits provides an electrostatic charge to the powder. The high velocity air and electric potential of the charged powder particles and the grounded stud cause the particles to adhere to the surface of the studs. Using a spraying method enables the coating of parts which are otherwise inconvenient to locate in a fluidized bed containing the powder.

In a further alternative method for coating the studs, the powder particles are fluidized in a fluidized bed and the stud is preheated. The preheated stud is then dipped into the powder and the powder adheres to the part. Application of an electrostatic charge is not necessary. In this method, a thicker coating is generally applied. However, this method does not generally allow removal of powder prior to curing, whereas the previously described electrostatic fluid bed and spraying processes enable the part to be selectively stripped prior to curing.

Preferably, the thickness of the powder coating ranges from 2 to 15 mils. A coating of 5 to 7 mils is preferred. It will be appreciated that the tops and bottoms of the studs are not coated and are masked over in the powder application processes.

The main terminal stud 10 is similarly coated with the powder as the collector terminal stud. However, the main terminal stud need not provide a sealing function between the stud and the rotor radial bore. That is, both sides of the main terminal stud are exposed to a hydrogen atmosphere. Thus, referring to FIG. 2, the main terminal stud 10, similarly as the collector terminal stud, includes a male threaded nut 70 which may be threaded in female threads in the radial bore engaging in an annular insulating ring 72 against a flange 74 on the terminal stud. The nut 70 is spaced from the stud. Thus, the terminal stud 10 is electrically insulated from the rotor.

The properties of the powder coating on the terminal studs in the environment of a generator are particularly effective for purposes of forming a seal as well as an electrical insulator. For example, the preferred powder coating, Epoxy 5230 manufactured by the 3M Company, has a dielectric strength in the coating thickness ranges given above of approximately 1100 V/mil. The impact strength of the powder coating, i.e., the integrity of the insulation, is greater than 200 inch/pounds. The relative thermal index, which quantifies the level of temperature at which insulation material can survive without degradation is about 155° C. The powder resin material also maintains its integrity, notwithstanding bending to a diameter of about 3 mm. Additionally, the chemical resistance to hydrocarbons and its adhesive characteristics are particularly good.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a hydrogen cooled dynamoelectric machine having a rotor, a radial bore in said rotor, a bore connector extending generally in an axial direction along a portion of the rotor and having a generally radially outwardly opening threaded aperture, a stud in said radial bore for electrically coupling said bore connector and electrical contacts carried by said rotor, said stud having a threaded connection at one end for threaded engagement with the bore connector in said threaded aperture thereof an electrical insulator about a portion of said stud for electrically insulating the stud and the rotor from one another, said insulator including a thermoset or thermoplastic powder resin coating on said insulator portion and a gasket in said bore sealing between the powder resin coating of the insulator and the bore thereby sealing between a hydrogen environment radially inwardly of the gasket and atmosphere radially outwardly of the gasket.

2. The apparatus according to claim 1 wherein said powder is provided on an intermediate portion of said stud spaced back from ends of the stud.

3. The apparatus according to claim 1 wherein said stud serves as a collector terminal stud in said rotor and includes a terminal opposite the first-mentioned threaded end for forming part of an electrical connection between the bore connector and collector rings in the rotor.

4. The apparatus according to claim 3 including a male threaded nut in said bore about said collector terminal stud cooperable with female threads in the bore and a shoulder in the bore for compressing said gasket to engage and seal against the powder resin coating.

5. The apparatus according to claim 3 wherein said electrical insulator is spaced from walls defining the bore.

6. The apparatus according to claim 1 wherein the powder resin coating is formed of said thermoplastic powder resin and has a thickness on said insulator portion of 2 to 15 mils.

7. The apparatus according to claim 1 wherein the powder resin coating has a thickness on said insulator portion of 5 to 7 mils.

8. In a dynamoelectric machine having a rotor, a radial bore in said rotor, a bore connector extending generally in an axial direction along a portion of the rotor and having a generally radially outwardly opening threaded aperture, a stud in said radial bore for electrically coupling said bore connector and electrical contacts carried by said rotor, said stud having a threaded connection at one end for threaded engagement with the bore connector in said threaded aperture thereof, a method of applying a resin powder to a stud comprising the steps of:

(a) providing a fluidized bed containing thermoset or thermoplastic powder;

(b) fluidizing the powder in the bed to a rolling boil;

(c) preheating the stud;

(d) disposing the stud into the powder within the bed to adhere the powder to the stud; and (e) curing the powder on the stud.

9. The apparatus according to claim 1 wherein said coating is substantially non-permeable to hydrogen.

* * * * *